US006600400B1

(12) United States Patent
Andou et al.

(10) Patent No.: US 6,600,400 B1
(45) Date of Patent: Jul. 29, 2003

(54) ELECTROMAGNETIC ELECTRO-ACOUSTIC TRANSDUCER

(75) Inventors: Kimihiro Andou, Mie (JP); Mitsutaka Enomoto, Mie (JP); Masaki Suzumura, Mie (JP); Katsuhiko Minaga, Mie (JP); Shuji Saiki, Nara (JP); Sawako Usuki, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/806,670

(22) PCT Filed: Sep. 6, 2000

(86) PCT No.: PCT/JP00/06033

§ 371 (c)(1),
(2), (4) Date: Jun. 27, 2001

(87) PCT Pub. No.: WO01/18787

PCT Pub. Date: Mar. 15, 2001

(30) Foreign Application Priority Data

Sep. 7, 1999 (JP) ..... 11/252399

(51) Int. Cl.[7] ..... H01F 7/10
(52) U.S. Cl. ..... 335/252; 335/302
(58) Field of Search ..... 335/252

(56) References Cited

U.S. PATENT DOCUMENTS 4,330,878 A 5/1982 Nakamura ..... 368/250
4,413,253 A 11/1983 Hofer et al. ..... 340/388
4,462,919 A * 7/1984 Saito et al. ..... 252/62.54
5,110,687 A * 5/1992 Abe et al. ..... 428/551
5,164,104 A * 11/1992 Kobayashi et al. ..... 252/62.54
5,872,501 A * 2/1999 Hamano et al. ..... 252/62.54

FOREIGN PATENT DOCUMENTS

JP 56-4087 1/1981
JP 56-168499 12/1981
JP 407240996 A * 9/1995 ..... H04R/13/00
JP 8-162312 6/1996

* cited by examiner

*Primary Examiner*—Lincoln Donovan
*Assistant Examiner*—Bernard Rojas
(74) *Attorney, Agent, or Firm*—McDermott, Will & Emery

(57) ABSTRACT

The present invention relates to an electromagnetic electro-acoustic transducer to be used for generating an incoming indicator tone for mobile phones and the like. A resin magnet 11 is formed with a hard magnetic material and a soft magnetic material, the lowest resonant frequency can be easily set by changing the magnetic flux density in a magnetic gap by changing the compound ratio of the soft magnetic material, a high magnetic flux density is attained by increasing the magnetic permeability of the resin magnet 11 with the soft magnetic material, thus achieving a smaller size as well as a higher sound pressure through an increase in the driving force exerted to the diaphragm.

13 Claims, 3 Drawing Sheets

(a)

(b)

ELECTROMAGNETIC ELECTRO-ACOUSTIC TRANSDUCER

FIELD OF THE INVENTION

The present invention relates to electromagnetic electro-acoustic transducers for generating an incoming indicator tone such as in mobile phones.

BACKGROUND OF THE INVENTION

Referring to FIG. 5, a description will be given on a conventional electromagnetic electro-acoustic transducer. FIG. 5 (*a*) is a top view and FIG. 5 (*b*) is a cross-sectional view.

The conventional electromagnetic electro-acoustic transducer comprises a first diaphragm 100, a second diaphragm 101 being a magnetic material attached on the center of the first diaphragm 100, a center pole 103 disposed opposite the second diaphragm 101, a coil 104 wound around the center pole 103, a ring-shaped resin magnet 105 positioned on the outer periphery of the coil 104, a yoke 106 in contact with or integrated with the center pole 103, and a cylindrical housing 107 that circumferentially supports the first diaphragm 100. A description will be given on the operation of an electromagnetic electro-acoustic transducer of the above configuration. In the initial state when no current is flowing in the coil 104, a magnetic circuit is formed by the resin magnet 105, second diaphragm 101, center pole 103, and yoke 106, and the second diaphragm 101 is attracted toward the resin magnet 105 and the center pole 103. Thereby the first diaphragm 100 is displaced to a position that balances with its elastic force.

Next, when an alternating current flows in the coil 104, an alternating magnetic field is generated by the magnetic circuit where the coil 104 works as a magnetomotive force. The magnetic flux density within the magnetic circuit is determined by the intensity of the alternating magnetic field and the magnetic resistance inside the magnetic circuit. In this case, the magnetic resistance is approximately equal to the combined resistance of the magnetic resistance due to the magnetic gap between the second diaphragm 101 and the center pole 103, the magnetic resistance due to a magnetic gap between the second diaphragm 101 and the resin magnet 105, and the magnetic resistance of the resin magnet 105 itself. The specific magnetic permeability of the resin magnet 105 is as low as that of the air and is approximately equal to 1, so that the magnetic resistance is high.

An alternating driving force is generated on the second diaphragm 101 due to a change in the magnetic flux density. As a result, the second diaphragm 101 moves from the initial position together with the attached first diaphragm 100 due to a static attraction force generated by the resin magnet 105 and a change in the alternating driving force generated by an alternating current. And its vibration radiates a sound.

The above-mentioned resin magnet 105 is a composite material consisting of a hard ferrite magnetic material, a polyamide resin such as nylon 6, nylon 12, and low molecular weight rubber. That is, the resin magnet 105 in the conventional transducer uses a composite material of a hard magnetic material and a resin.

By the way, as electromagnetic electro-acoustic transducers are used in mobile phones and the like, their small size and a high sound pressure are required for their alternating driving force. Accordingly, the acuteness of resonance, Q-factor of the mechanical resonant system consisting of the first diaphragm 100 and the second diaphragm 101 is made high, and the lowest resonant frequency of the mechanical resonant system are made close to the regeneration acoustic frequency.

Also, while the lowest resonant frequency of the mechanical resonant system is determined by the effective masses of the first diaphragm 100 and the second diaphragm 101 and the stiffness of the first diaphragm 100, the stiffness of the first diaphragm 100 is not only affected by the modulus of elasticity and thickness of the material used but also by the configuration of deformation due to the static attraction force by the resin magnet 105 and the center pole 103.

The conventional electromagnetic electro-acoustic transducer as described above suffered a problem of resolving the complicated situation as described below in order to obtain an electromagnetic electro-acoustic transducer with a desired characteristic.

(1) In order to change the lowest resonant frequency of the mechanical system depending on the regenerated acoustic frequency, it is necessary to change the effective mass and stiffness of the mechanical resonant system. In doing this, it is necessary to change the thickness of the first diaphragm 100 and the thickness and diameter of the second diaphragm 101, or to change the magnetic gap between the second diaphragm 101 and the center pole 103 in order to change the static attraction force. Such changes in the thickness and diameter of the second diaphragm 101 will result in changes in the magnetic resistance and in various interacting mechanical parameters including effective mass and vibration mode the regeneration acoustic frequency. Consequently such a design change to get a desired characteristic become complicated.

(2) As the acuteness of resonance, Q-factor of the mechanical resonant system is high, the ratio of contribution of the lowest resonant frequency to sound pressure is extremely high, making sound pressure variation due to a slight change in a magnetic gap or in the thickness of the diaphragm large.

However, in order to make the acuteness of resonance, Q-factor low, although lightening of the mass of the vibratory system or an increase in the driving force (force coefficient) is necessary, lightening of the mass of the vibratory system makes the volume of the second diaphragm 101, being a magnetic material, small and will result in an increase in the magnetic saturation and magnetic resistance thus resulting in a decrease in the force coefficient.

Also, in order to increase the force coefficient, it is necessary to increase either direct current magnetic flux density or alternating current magnetic flux density; and in order to increase the direct current magnetic flux, it is necessary to increase energy of the magnet or upsize the diaphragms thus leading to upsizing of the total size or an increase in the mass of the vibratory system.

Although it is necessary to decrease the magnetic resistance in order to increase the alternating current magnetic flux, it is difficult as the magnetic permeability of conventional resin magnet 105 is low. There is other approach such as making the magnetic gaps small but it makes vibration amplitude of the diaphragms small.

DISCLOSURE OF THE INVENTION

The present invention resolves the above-described problems and provides an electromagnetic electro-acoustic transducer in which the cost is low, the lowest resonant frequency of the mechanical system is variable, and variation of sound pressure at high sound pressures is narrow.

A first embodiment of the present invention comprises a first diaphragm, a second diaphragm attached at the center of the first diaphragm and consisting of a magnetic material smaller than the first diaphragm, a center pole provided underneath the center 6f the second diaphragm with a magnetic gap in between, a coil wound around the outer periphery of the center pole, a ring-shaped resin magnet, and a yoke disposed in a manner such that it comes in contact with the lower parts of the center pole. Here, the magnetic powder of said resin magnet consists of powders of a hard magnetic material and a soft magnetic material, the magnetic flux density and the magnetic permeability can be controlled by changing their compounding ratio, so that lowest resonant frequency and the high sound pressure can be set very easily.

A second embodiment of the present invention is one in which the magnetic powder orientation of the resin magnet of the first embodiment is aligned by injection molding in magnetic field. Magnetic energy is enhanced when magnetizing the hard magnetic material in the resin magnet, -thereby obtaining a resin magnet with a high magnetic flux density and a high magnetic permeability jointly by mixing of a soft magnetic material.

A third embodiment of the present invention is one in which the hard magnetic material in the resin magnet of the first embodiment is a eutectic composition of a ferrite magnetic material and a rare-earth magnetic material. By employing a eutectic composition of a ferrite and a rare-earth magnetic material as the resin magnet, a higher magnetic flux density is obtained thereby enabling provision of a further superior electromagnetic electro-acoustic transducer.

A fourth embodiment of the present invention is one in which the total amount of the magnetic powder within the resin magnet of the first embodiment is in the range 85 to 92% by weight thus enabling fabrication of a resin magnet with superior moldability and magnetic characteristic thereby providing a superior electromagnetic electro-acoustic transducer A fifth embodiment of the present invention is one in which a ring-shaped magnetic plate with an inner diameter smaller than the outer diameter of the second diaphragm is attached on the upper surface of the resin magnet of the electromagnetic electro-acoustic transducer of the first embodiment. As the magnetic resistance can be further reduced with this construction, a higher magnetic flux density can be obtained thereby making it possible to increase the compounding ratio of the soft magnetic material and enabling expansion of controllable ranges of the lowest resonant frequency and the sound pressure.

A sixth embodiment of the present invention is one in which the ratio of the soft magnetic material powder in the resin magnet of the electromagnetic electro-acoustic transducer of the first to the fifth embodiments is in the range 15 to 30% by weight and is capable of providing an transducer employing a superior resin magnet with a practical magnetic flux density and a high magnetic permeability.

A seventh embodiment of the present invention disposes a first diaphragm, a second diaphragm attached at the center of the first diaphragm and consisting of a magnetic material smaller than the first diaphragm, a center pole provided underneath the center of the second diaphragm with a magnetic gap in between, a coil wound around the outer periphery of the center pole, a ring-shaped magnet disposed on the outside of the coil, a yoke disposed in a manner such that it comes in contact with the lower parts of the center pole, and a ring-shaped magnetic plate having an inner diameter designed in a manner such that the magnetic flux from the second diaphragm enters generally vertically. This embodiment provides an electromagnetic electro-acoustic transducer in which a magnetic circuit is formed in a manner such that the magnetic flux of the magnet returns to the magnet through the yoke, center pole, second diaphragm and the magnetic plate, so that magnetic resistance is reduced by going through the magnetic plate, magnetic flux density is enhanced, and the attraction force toward the second diaphragm is almost maximized thus improving magnetic efficiency.

DESCRIPTION OF THE PREFERRED EMBODIMENTS

Referring to FIGS. 1 to 4, a description will be given on exemplary embodiments of the present invention.

Figure 1:
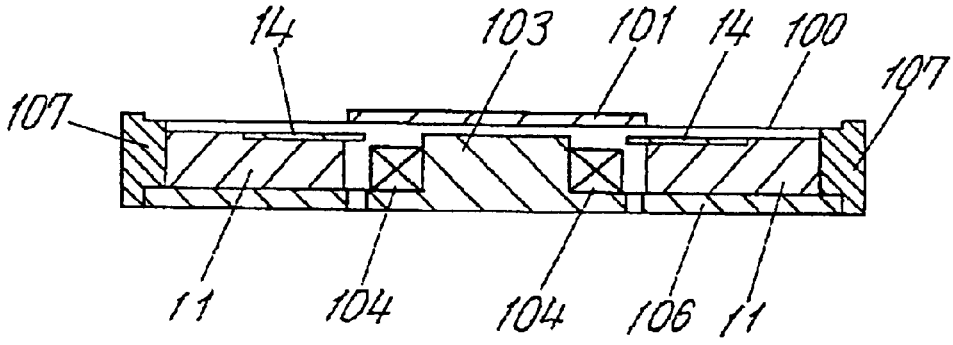
FIG. 1 is a cross-sectional view of an exemplary embodiment of the electromagnetic electro-acoustic transducer of the present invention.
Figure 2:
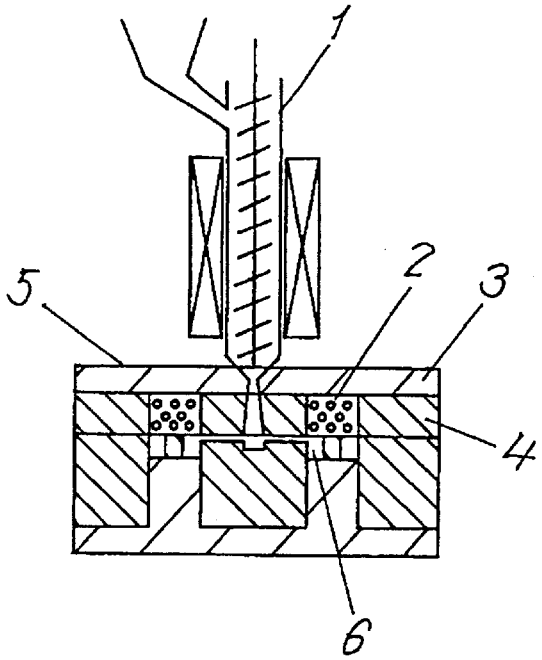
FIG. 2 is a cross-sectional view of a molding equipment for molding a resin magnet to be used in the transducer of the present invention.
Figure 3:
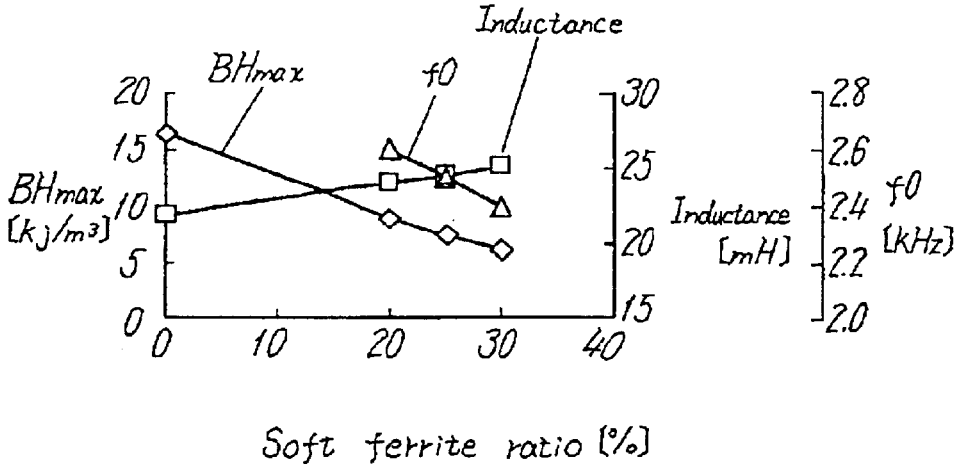
FIG. 3 is the graph plots illustrating energy of magnet, inductance, and lowest resonant frequency of the resin magnet as a function of the compounding ratio of the soft magnetic material in the resin magnet.
Figure 4:
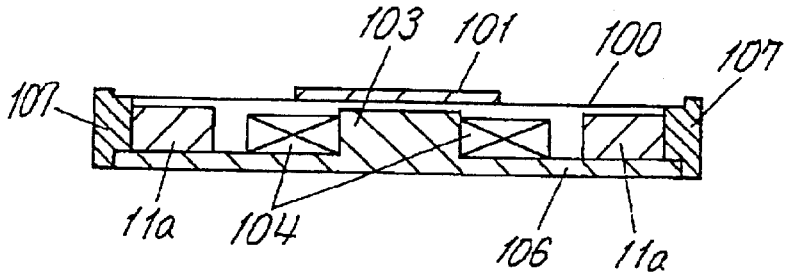
FIG. 4 is a cross-sectional view of an extended example of the transducer of the present invention.
Figure 5:
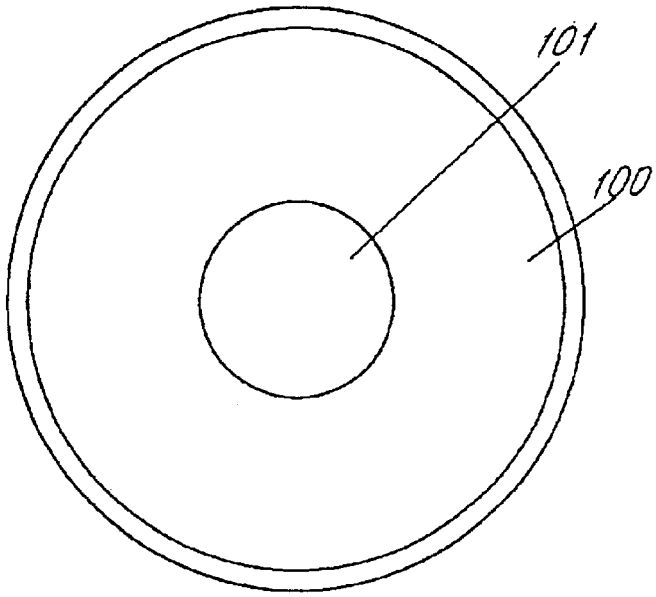
FIG. 5 is a top view (a) and a cross-sectional view (b) of an conventional electromagnetic electro-acoustic transducer.
Figure 5:
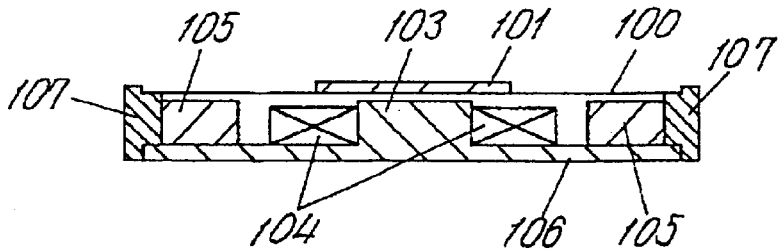

FIG. 1 is a cross-sectional view of the electromagnetic electro-acoustic transducer in an exemplary embodiment of the present invention. FIG. 2 is a cross-sectional view of a molding equipment for the resin magnet, which is an essential part of the transducer in an exemplary embodiment of the present invention. FIG. 3 is the characteristics illustrating energy of magnet, inductance, and lowest resonant frequency of the resin magnet as a function of the compounding ratio of hard and soft magnetic materials. FIG. 4 is a cross-sectional view of a transducer in a first exemplary embodiment of the present invention.

As the difference between the exemplary embodiments of the present invention and prior art lies in the composition of the resin magnet and the magnetic plate, a description on the difference will be given below.

In FIG. 1, a resin magnet 11 is produced through mixing of soft magnetic powder hard magnetic powder and resin as binder, subsequently molding process and magnetizing process.

Here, a hard magnetic material generally means a magnetic material that is not easily influenced by an external magnetic field. In this exemplary embodiment, Sr ferrite is used. Ferrite magnetic powder can provide a high magnetic flux density when injection molded while aligning the magnetic orientation as described later. A soft magnetic material generally means a magnetic material that is easily influenced by an external magnetic field. In this exemplary embodiment, MgZn ferrite is used. The particle size being several $\mu$m, MgZn ferrite is easily made into a composite, and provides: a high magnetic permeability.

As the molding resin, polyamide resins such as nylon 6 and nylon 12 are used as they have a high orientation efficiency during injection molding while aligning the magnetic orientation. From the standpoint of moldability and magnetic characteristic, it is appropriate to set the amount of the total magnetic powder at 85 to 92% by weight and the remainder for the molding resin.

Numeral 14 is a magnetic plate attached integrally with the resin magnet 11 on the resin magnet 11 by insertion molding. As is clear from FIG. 1, the inner diameter of the magnetic plate 14 is made smaller than the outer diameter of the second diaphragm 101.

With this configuration, a magnetic circuit is formed in which the magnetic flux of the resin magnet 11 returns to the resin magnet 11 going through a yoke 106, center plate 103, second diaphragm 101, and magnetic plate 14. By going through the magnetic plate 14, the magnetic resistance is reduced and the magnetic flux density can be enhanced. Though the inner diameter of the magnetic plate 14 is smaller than the outer diameter of the second diaphragm 101, when the inner diameter is too small, either the magnetic flux between the second diaphragm 101 and the magnetic plate 14 diffuses, or in the extreme case, the magnetic flux between the center pole 103 and the magnetic plate 14 disappear , and the magnetic force for attracting the second diaphragm 101 to the center pole 103 becomes weak. Consequently, the inner diameter of the magnetic plate 14 is set in a manner such that the magnetic flux between the second diaphragm 101 and the magnetic plate 14 will not diffuse but will generally be in a vertical position (a position in which the attraction force toward the second diaphragm 101 is roughly at the maximum).

Also, as the magnetic plate 14 is attached with the resin magnet 11 by insertion molding, its positional relation to the second diaphragm 101 is determined through the housing 107 with a small variation in manufacturing ,thereby attraction force toward the second diaphragm 101 is stabilized and, accordingly, the variation of sound pressure of the electromagnetic electro-acoustic transducer is also well controlled.

Next, FIG. 2 is a molding equipment for fabricating the resin magnet 11, where a molding die 5 is provided with a magnetic material 3 for aligning the magnetic orientation in the direction of the thickness and a non-magnetic material 4. A resin magnet 2 for aligning is disposed inside the molding die 5, a compound of a resin, powder of,a hard magnetic material, and powder of a soft magnetic material is filled inside a cavity 6, and subsequently heated and injection molded to obtain a resin magnet. (During this process, the magnetic plate 14 is set inside the molding die 5 and is integrally molded.)

FIG. 3 plots the energy of magnet, inductance, and lowest resonant frequency as a function of the compounding ratio of MgZn ferrite used as the soft magnetic material in the resin magnet 11. As it is difficult to directly measure the magnetic permeability of the resin magnet, inductance is measured in place of the magnetic permeability (magnetic permeability tends to increase proportionally with increasing inductance ). From the plots, it is found that, with an increase in the compounding ratio of the, soft magnetic material, the energy (BHmax) of the resin magnet decreases, the lowest resonant frequency ($f_0$) decreases, and the inductance increases (magnetic resistance decreases and magnetic permeability increases).

It is also confirmed that, as electromagnetic electro-acoustic transducers are small with an approximate size of 12 mm square, and the designed regeneration acoustic frequency is in the range 2.5 KHz to 3.5 KHz, the practical compounding ratio of the soft magnetic material in the resin magnet 11 is in the range 15 to 30%.

That is, when the compounding ratio of the soft magnetic material is less than 15%, enough magnetic permeability is not obtained, while, when it is more than 30%, the magnetic flux density becomes low and the lowest resonant frequency becomes too low. From the above, it is possible to continuously change the static attraction force by changing the ratio of the soft magnetic material and to easily control the lowest resonant frequency. Also, by mixing a soft magnetic material, it is possible to increase the magnetic permeability of the resin magnet 11 and to decrease the magnetic resistance of the resin magnet 11, thereby increasing the magnetic flux density for an alternating magnetic field and increasing the driving force exerted to the diaphragm.

It is to be noted that, by further providing the magnetic plate 14, the magnetic resistance can be reduced and the magnetic flux density can be increased, thus attaining a higher sound pressure.

FIG. 4 is an extended example of the present exemplary embodiment. Here, though a resin magnet 11*a* made by mixing a hard magnetic material and a soft magnetic material similar to the electromagnetic electro-acoustic transducer of FIG. 1 is used, a difference lies in that it does not use a magnetic plate 14. When compared with the transducer of FIG. 1, a decrease in the magnetic resistance between a second diaphragm 101 and the resin magnet 11*a* cannot be obtained as it does not have a magnetic plate 14. However, it is easy to set the lowest resonant frequency and it is possible to obtain a higher sound pressure and a lower cost by the use of the resin magnet 11*a* prepared by mixing a hard magnetic material and a soft magnetic material.

In the above exemplary embodiments, although a description has been made on the use of Sr ferrite as the hard magnetic (powder) material, a resin magnet that has a higher magnetic flux density than that using Sr ferrite alone can be obtained by using a eutectic;compound of a rare-earth magnetic material and Sr ferrite. Here, as the rare-earth magnetic material, a nano-composite magnetic material such as Nd—Fe—B magnetic material can be used.

INDUSTRIAL APPLICABILITY

By combining a hard magnetic material and a soft magnetic material as the magnetic material of a resin magnet as has been described above, the present invention provides an electromagnetic electro-acoustic transducer of which the magnetic permeability is high, the lowest resonant frequency can be easily set by continuously changing the magnetic flux density depending on the compounding ratio of the soft magnetic material, and the sound pressure is high and narrow variation at high sound pressure range.

What is claimed is:

1. An electromagnetic electro-acoustic transducer comprising a first diaphragm, a second diaphragm attached at the center of the first diaphragm and made of a magnetic material smaller in size than the first diaphragm, a center pole provided underneath the center of the second diaphragm with a magnetic gap in between, a coil wound on the outer periphery of the center pole, a ring-shaped resin magnet, and a yoke disposed in a manner such that it comes in contact with the lower parts of the center pole, wherein the resin magnet consists of powder of a hard magnetic material and powder of a soft magnetic material based on a compounding ratio defining the amount of the soft magnetic material relative to the hard magnetic material contained in said resin magnet, wherein the magnetic flux density and the magnetic permeability is controlled by varying said compounding ratio such that the lowest resonant frequency and the sound pressure can be adjusted.

2. The electromagnetic electro-acoustic transducer of claim 1, wherein the magnetic orientation of the resin magnet is aligned in a given direction by injection molding said resin magnet in a magnetic field.

3. The electromagnetic electro-acoustic transducer of claim 1, wherein the hard magnetic material of the resin magnet is a eutectic composition of a ferrite magnetic material and a rare-earth magnetic material.

4. The electromagnetic electro-acoustic transducer of claim 1, wherein the ratio of the total magnetic powder in the resin magnet is in the range 85 to 92% by weight.

5. The electromagnetic electro-acoustic transducer of claim 1, wherein a ring-shaped magnetic plate having a diameter smaller than the outer diameter of the second diaphragm is disposed on the upper surface of the resin magnet.

6. The electromagnetic electro-acoustic transducer of claim 1, wherein the compounding ratio is in the range 15 to 30% by weight.

7. The electromagnetic electro-acoustic transducer of claim 2, wherein a ring-shaped magnetic plate having a diameter smaller than the outer diameter of the second diaphragm is disposed on the upper surface of the resin magnet.

8. The electromagnetic electro-acoustic transducer of claim 3, wherein a ring-shaped magnetic plate having a diameter smaller than the outer diameter of the second diaphragm is disposed on the upper surface of the resin magnet.

9. The electromagnetic electro-acoustic transducer of claim 4, wherein a ring-shaped magnetic plate having a diameter smaller than the outer diameter of the second diaphragm is disposed on the upper surface of the resin magnet.

10. The electromagnetic electro-acoustic transducer of claim 2, wherein the compounding ratio is in the range 15 to 30% by weight.

11. The electromagnetic electro-acoustic transducer of claim 3, wherein the compounding ratio is in the range 15 to 30% by weight.

12. The electromagnetic electro-acoustic transducer of claim 4, wherein the compounding ratio is in the range 15 to 30% by weight.

13. The electromagnetic electro-acoustic transducer of claim 5, wherein the compounding ratio in the range 15 to 30% by weight.

* * * * *